United States Patent [19]

von Holst et al.

[11] Patent Number: 4,973,356

[45] Date of Patent: Nov. 27, 1990

[54] METHOD OF MAKING A HARD MATERIAL WITH PROPERTIES BETWEEN CEMENTED CARBIDE AND HIGH SPEED STEEL AND THE RESULTING MATERIAL

[75] Inventors: Peder von Holst; Håkan Morberg, both of Sandviken; Rolf Oskarsson, Rönninge, all of Sweden

[73] Assignee: Sandvik AB, Sandviken, Sweden

[21] Appl. No.: 425,121

[22] Filed: Oct. 23, 1989

[30] Foreign Application Priority Data

Oct. 21, 1988 [SE] Sweden ..... 8803777

[51] Int. Cl.[5] ..... C22C 29/12

[52] U.S. Cl. ..... 75/233; 75/232; 75/234; 75/235; 75/236; 75/237; 75/239; 75/240; 75/242; 75/244; 419/12; 419/13; 419/14; 419/15; 419/16; 419/17; 419/18; 419/19; 419/48; 419/68

[58] Field of Search ..... 419/12, 13, 14, 15, 419/16, 17, 18, 19, 48, 68; 75/232, 233, 234, 235, 236, 237, 239, 240, 244, 242

[56] References Cited

U.S. PATENT DOCUMENTS

| | | | |
|---|---|---|---|
| 4,145,213 | 3/1979 | Oskarsson et al. | 75/238 |
| 4,519,839 | 5/1985 | Toyoaki et al. | 75/242 |
| 4,618,540 | 10/1985 | von Holst et al. | 428/552 |
| 4,719,078 | 1/1988 | Miyashita et al. | 419/53 |

*Primary Examiner*—Stephen J. Lechert, Jr.
*Assistant Examiner*—Leon Nigohosian, Jr,
*Attorney, Agent, or Firm*—Burns, Doane, Swecker & Mathis

[57] ABSTRACT

The present invention relates to a method of preparing an alloy for use as a cutting tool material comprising hard principles and binder phase by which a uniform distribution of the hard principles in the binder phase is obtained, and the resulting product.

17 Claims, 1 Drawing Sheet

METHOD OF MAKING A HARD MATERIAL WITH PROPERTIES BETWEEN CEMENTED CARBIDE AND HIGH SPEED STEEL AND THE RESULTING MATERIAL

BACKGROUND OF THE INVENTION

For a long time, there has been a desire for a material having properties between those of cemented carbide and high speed steel. The aim of such a material would be to achieve the positive properties of each type of material, such as the high wear resistance or cemented carbide and the good toughness behavior of high speed steel.

A part of the range of properties between cemented carbide and high speed steel is covered by the material made according to U.S. Pat. No. 4,145,213 which relates to an alloy manufactured by powder metallurgy and comprising 30–70 percent by volume of hard principles in a metallic binder phase. The hard principles are extremely fine-grained having a mean grain size of 0.04–0.70/μm. The binder phase is based on Fe, Ni and/or Co. The hard principles comprise especially carbides, nitrides and/or carbonitrides based on Ti, Zr, Hf, V, Nb, Ta, with additions of essentially Cr, Mo and/or W. Such a material is more like cemented carbide than high speed steel with respect to properties such as cutting material and machinability.

A method of preparing powder of the desired kind is disclosed in U.S. patent application Ser. No. 163,155 filed Feb. 25, 1988 as a continuation of U.S. patent application Ser. No. 906,437, filed Sept. 12, 1986 and now abandoned. However, the manufacturing of final cutting tools from the type of material discussed above can give rise to considerable processing problems. Grinding, for example, involves problems because the material causes wear and also contains so much binder phase that the grinding wheels become clogged leading to burning, etc. These problems have been solved by the techniques disclosed in U.S. Pat. No. 4,618,540, including a compound design which makes manufacturing of complicated tools such as shank end mills possible, in which the positive properties of the hard material such as wear resistance have been combined with the toughness behavior of a steel core material. This design also solved the grinding problems in an economically satisfactory way.

It has now been found, however, that there is a need of a material having a considerably improved wear resistance as a cutting tool material in chipforming machining compared to high speed steel and which is also machinable with conventional cutting tools to manufacture the desired tool. The hard material referred to above is, of course, less suitable in this respect.

Attempts have been made to improve high speed steel by powder metallurgy. Powder metallurgyhhas shown significant advantages over conventional metallurgy which uses large ingots rolled to desired dimensions. By means of powder metallurgy, much greater amounts of carbides can be used in high speed steels than by conventional melt metallurgy. The practical maximum limit for alloying of high speed steels is about 2.3% C, 7% Mo, 6.5% W, 6.5% V and 4% Cr. In addition, there is an upper limit of about 12% for Co after which the material shows extensive brittle behavior. These limits are the practical limits before precipitation of large primary carbides takes place in the melt. Such a material is commercially available and represents an advanced high speed steel with respect to wear resistance. It is built up of well balanced alloying additions and has a controlled mean grain size of 1–2/μm.

It has also been attempted by powder metallurgical techniques to increase the amount of hard principles in 'more simple' high speed steels such as type M2 (0.9% C, 4.0% Cr, 5.0% Mo, 6.5% W, 2% V, remainder Fe and normal impurities). In such attempts, a high speed steel powder was prepared by granulation after which additional hard principles in the form of elementary powders such as, for example, pure carbides, preferably TiC, were mixed. Thereafter, the procedure was continued as if no additional hard principles were present, for example, by cold isostatic pressing (CIP)+hot isostatic pressing (HIP)+hot rolling. Such attempts have not been successful because the added hard principles are not uniformly distributed in the material usually forming clods and, in most cases, present as long bands in the working direction. This gives rise to weaknesses in the material being at least as serious as the carbide bands present in conventional high speed steels as a consequence of segregations during the solidification of large ingots. Tools manufactured from such a material are characterized as having not only a more evident brittleness behavior than the powder metallurgical high speed steels discussed above but also an insufficient wear resistance in many applications because large areas are too soft which leads to nonuniform edges and rapid wear in the form of flaws which will undermine the integrity of the material and give rise to total breakdown.

The hard material of U.S. Pat. No. 4,145,213 has a transverse rupture strength corresponding to that of the most high-alloyed high speed steels on the market.

It has now been found that the amount of hard principles in a high speed steel powder can be increased to a desired level by adding said hard material or, by a contrary mode of expression, decrease the amount of hard principles in the hard material by 'dilution' with high speed steel powder to obtain the desired advantages, i.e., a material having a considerably improved wear resistance behavior compared to high speed steel but still being machinable by means of turning, milling, drilling, etc. and without obtaining negative properties such as an impaired macro toughness behavior and an uneven distribution of harder and softer parts.

Materials having the above-mentioned properties are particularly desirable when making tools, the manufacture of which involves the removal of large amounts of material and also for tools in which plain hard material is used, e.g., end mills, drills, reamers, hobs, threading tools, etc., in which some of the wear resistance can be sacrificed in order to obtain an improved toughness behavior. As known, no material is complete but each type of material has its particular uses and application areas.

SUMMARY AND ADVANTAGES OF THE INVENTION

In one aspect of the present invention, there is provided a method of making a cutting tool material comprising consolidating in the solid state a mixture of from 25 to 75% by volume of a hard material powder and from 75 to 25% by volume of a high speed steel powder, said hard material powder comprising 30 to 70% by volume of carbides, nitrides, oxides and/or borides of Ti, Zr, Hf, V, Nb, Ta, Mo, Cr and/or W, remainder comprising a binder metal based on Fe, Ni and/or Co.

In another aspect, there is provided a cutting tool comprising at least one cutting edge wherein said cutting edge comprises the product of the process described in the preceding paragraph.

In still another aspect, there is provided a cutting tool having at least one cutting edge comprised of a mixture consolidated in the solid state of 25 to 75% by volume of a hard material powder and 75 to 25% by volume of a high speed steel, said hard material powder comprising 30 to 70% by volume of carbides, nitrides, oxides and/or borides of Ti, Zr, Hf, V, Nb, Ta, Mo, Cr and/or W, remainder comprising a binder metal based on Fe, Ni and/or Co.

In yet another aspect, there is provided the method of making a compound body wherein a first component of 25 to 75% by volume of a hard material powder and 75 to 25% by volume of a high speed steel, said hard material powder comprising 30 to 70% by volume of carbides, nitrides, oxides and/or borides of Ti, Zr, Hf, V, Nb, Ta, Mo, Cr and/or W, remainder comprising a binder metal based on Fe, Ni and/or Co, and a second component selected from the group of (a) hard materials comprising from 30 to 70% by volume of hard constituents of particles selected from the group consisting of Ti, Zr, Hf, V, Nb, Ta, Mo, Cr and/or W and mixtures thereof in a matrix based on a metal selected from the group consisting of Fe, Ni, Co and mixtures thereof; and (b) high speed steel or tool steel are compacted by cold isostatic pressing to form an extrusion billet which is thereafter hot extruded to form a compound body blank.

Thus, the problem of an unfavorable distribution of hard principles and binder phase, said problem being created when 'pure' hard principles are added to a high speed steel or another steel powder, can be avoided according to the present invention by mixing said high speed steel powder with a powder containing hard principles as well as binder phase. It has been found, however, that the latter must be a powder having 30–70% by volume of extremely fine grained hard principles. So-called conventional cemented carbide powder based on WC-Co does not work but gives the same disadvantages as the pure hard principles. The two kinds of powders to which the invention relates, i.e., high speed steel powder and powder with 30–70% by volume of hard principles according to earlier description, have shown a surprisingly good ability of mixing and deagglomeration which will give said combination of materials unique properties.

DETAILED DESCRIPTION OF THE INVENTION

According to the present invention, each type of component powder shall comprise 25–75%, preferably 30–70%, by volume of the mixture. The hard material powder contains 30–70% by volume of hard principles based on carbides, nitrides, oxides and/or borides of Ti, Zr, Hf, V, Nb, Ta, Cr, Mo and/or W and a binder metal based upon Fe, Co and/or Ni. The hard material powder has a particle size (mean grain size) of from about 1 to 6, preferably from about 2 to 8, μm. The hard principles in these powder particles have a mean grain size of 0.02 to 0.80, preferably 0.03 to 0.60, μm.

The high speed steel powder can be known commercially available grades as well as newly developed types of high speed steel. A relatively simple alloy such as type M2 with an analysis as above and without cobalt is preferably chosen but also cobalt-alloyed high speed steels having better high temperature properties can be used depending upon the application. The particle size of the high speed steel powder is less critical and can be from about 1 to 700, preferably from about 40 to 400, μm. Similar particle sizes can be used when tool steel is employed. The composition of the tool steel can be any conventional tool steel alloy.

The powders are compacted in solid state, that is, in the absence of a liquid phase. The compaction is suitably performed by mixing/milling + cold isostatic pressing (CIP) + hot extrusion.

Figure 1:
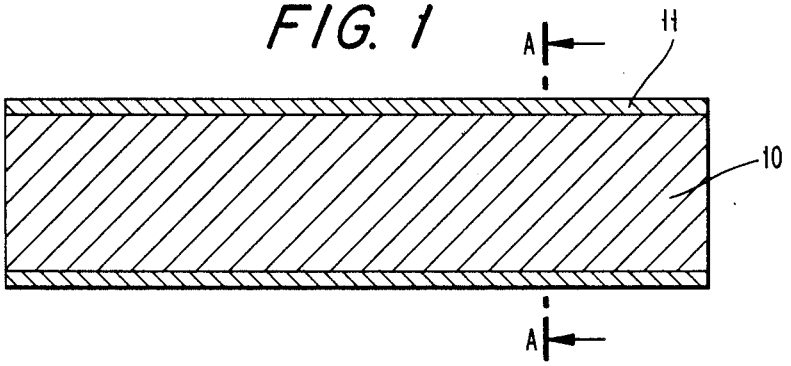
FIG. 1 is a cross-sectional view of an extrusion billet made according to the process of the present invention.
Figure 2:
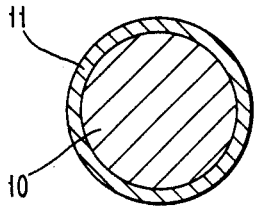
FIG. 2 is a cross-sectional view of the complete extrusion billet of FIG. 1 taken along line A—A.

A granulated high-speed steel powder is mixed with the hard material powder (including the Fe, Co and/or Ni binder) and (see FIG. 1) the mixture 10 placed into a can 11 which can be made of an acceptable steel material, for example, stainless steel. The can is closed at both ends with a vacuum being applied to evacuate air from the mixture prior to sealing of the can (not shown). The thus-formed sealed can is then subjected to cold isostatic pressing and hot extrusion to form a body consolidated in the solid state, that is, without the presence of a liquid phase.

Figure 3:
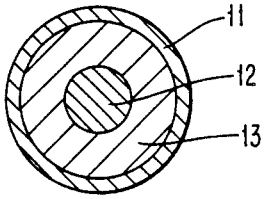
FIG. 3 is a cross-sectional view along the same line of an alternative extrusion billet made according to the process of the present invention.

In the embodiment shown in FIG. 3, a mixture of 25–75 volume % hard material and 75–25% high speed steel can first be precompacted in the solid state, for example, by cold isostatic pressing, to form a preformed body 12 which is then placed within the can 11. The precompacted body 12 can then be surrounded by hard material powder 13, which hard material powder can be the same as that mixed with the high speed steel powder. Although shown as a cylindrical precompacted body 12 in FIG. 3 the shape is arbitrary and may be different depending upon the desired product. Alternatively, the hard material 13 can be precompacted in the solid state with a hollow center into which the hard material-high speed steel mixture 12 can be introduced as a powder.

Figure 4:
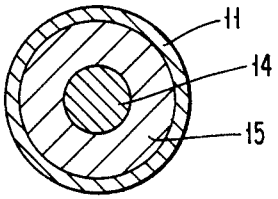
FIG. 4 is a cross-sectional view along the same line of an alternative extrusion billet made according to the process of the present invention.

In FIG. 4, an alternative embodiment is shown in which a body 14 precompacted in the solid state and made of high speed steel or tool steel, is placed within the can 11 and the space around it is filled with the mixture of from 25–75 volume percent of hard material and 75–25 volume percent high speed steel. Again, the shape of the precompacted body 14 can be determined according to the desired use. Also, the hard material-high speed steel mixture can be precompacted with a hollow center into which the steel 14 can be introduced as a powder.

The temperature of the hot extrusion should not exceed 1250° C., preferably at the most 1200° C., in order to avoid sintering and grain growth of the hard principles in the hard material powder. It has been found that the extremely fine grain size of the hard principles of the hard material does not change by the process according to the invention. Also, the grain size of the hard principles of the high speed steel powder (which normally is much greater than that of the hard material or of the order of 1-2 μm) does not change appreciably in the procedure according to the invention.

Figure 5:
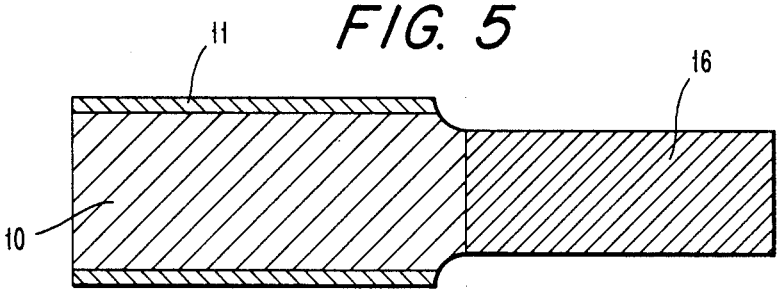
FIG. 5 shows a longitudinal section of a tool made according to the process of the present invention.

As shown in FIG. 5, the material according to the invention 10 after hot extrusion may be provided with a shaft 16 of steel or similar metal or metal alloy attached by means of welding, for example, frictional welding. The type and manner of welding can be chosen by the skill of artisan. In addition, depending upon the end use, the can 11 may be removed prior to use of the body 10 which at this point has been compacted in the solid state.

After compaction, the billets are surprisingly easy to machine with conventional cutting tools and also surprisingly easy to weld to steel by friction welding methods. Said procedures would be very difficult if the billets had been prepared from powder having simply a content of hard principles of 50%. A welded shaft means a considerably lower consumption of the expensive hard material and is therefore economically advantageous for tools above a certain diameter.

Tools according to the invention are well suited for coating by means of, for example, PVD (physical vapor deposition) because the material supports the coating layer much better than high speed steel which leads to a superior interaction between layer and substrate.

The invention is additionally illustrated in connection with the following Examples which are to be considered as illustrative of the present invention. It should be understood, however, that the invention is not limited to the specific details of the Examples.

EXAMPLE 1

About 50% by weight of inert gas-granulated high speed steel powder, type M2, was mixed with 50% by volume of hard material powder containing 23,5% Ti, 7% N, 0.6% C, 7.5% Co, 6% W, 5% Mo, 4% Cr and rest Fe (besides normally present other alloying elements and impurities) in an ordinary mixer for 60 minutes giving a powder from which billets for hot extrusion were cold isostatically pressed at 200 MPa. The dimension of the billets was $\phi$69.5 (diameter)×300 mm. The billets were vacuum annealed at 1200° C. for 2 hours, after which they were encapsulated in extrusion cans of carbon steel $\phi_i$ (internal diameter) 70 mm and with a wall thickness of 3 mm. The cans were evacuated and sealed after which they were heated to 1150° C. for 1 hour and extruded to round bar $\phi$24 mm. From said round bar end mills were made which had properties between high speed steel and the above-described hard material, i.e., it had a superior wear resistance compared to that of high speed steel and very good toughness behavior in relation to the high content of hard principles (being much better than that of the most high-alloyed high speed steels on the market) but still having an excellent machinability.

EXAMPLE 2

Example 1 was repeated but water granulated high speed steel powder was used, the carbon content of which was compensated in order to make up for the loss of carbon being the result of the reduction of oxides during the vacuum annealing at about 1200° C. Also these tests showed superior tools compared to high speed steel.

EXAMPLE 3

Four-flute shaft end mills of the dimension 12 mm and made of a material according to the present invention was manufactured and tested by chipforming machining of machine steel and tough hardening steel. The tools could be produced in equipment similar to that being normally used for the corresponding high speed steel tools and having the same productivity. The performance of the tools in normal use showed two times higher possible cutting data and simultaneously two times longer mean life than corresponding high speed steel tools. At an accelerated test, i.e., at higher cutting data meaning higher cutting edge temperatures, the difference in life was 10-fold. In all tests better surface on the cut piecc was obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A method of making a cutting tool material comprising consolidating in the solid state a mixture of from 25 to 75% by volume of a hard material powder and from 75 to 25% by volume of a high speed steel powder, said hard material powder comprising 30 to 70% by volume of a compound selected from the group consisting of carbides, nitrides, oxides, borides and mixtures thereof of a metal selected from the group consisting of Ti, Zr, Hf, V, Nb, Ta, Mo, Cr, W and mixtures thereof, remainder comprising a binder metal selected from the group consisting of Fe, Ni, Co and their alloys.

2. The method of claim 1 wherein the mixture contains from 30 to 70% by volume of the hard material powder and from 70 to 30% by volume of the high speed steel powder.

3. The method of claim 1 wherein the high speed steel contains cobalt.

4. The method of claim 1 wherein the high speed steel powder is of the type M2 comprising in percent by weight 0.9% C, 4.0% cr, 5.0% Mo, 6.5% W, 2% V, balance Fe and incidental impurities..

5. The method of claim 1 wherein the consolidated material is thereafter welded to a shaft.

6. A cutting tool comprising at least one cutting edge wherein at least said cutting edge comprises the product of the process of claim 1.

7. A cutting tool having at least one cutting edge comprised of a mixture consolidated in the solid state of 25 to 75% by volume of a hard material powder and 75 to 25% by volume of a high speed steel, said hard material powder comprising 30 to 70% by volume of a compound selected from the group consisting of carbides, nitrides, oxides, borides and mixtures thereof, of a metal selected from the group consisting of Ti, Zr, Hf, V, Nb, Ta, Mo, Cr, W and mixtures thereof, remainder comprising a binder metal selected from the group consisting of Fe, Ni, Co and their alloys.

8. The cutting tool of claim 7 wherein the mixture contains from 30 to 70% by volume of the hard material powder and from 70 to 30% by volume of the high speed steel powder.

9. The cutting tool of claim 7 wherein the high speed steel contains cobalt.

10. The cutting tool of claim 7 wherein the high speed steel powder is of the M2 type comprising in percent by weight 0.9% C, 4.0% cr, 5.0% Mo, 6.5% W, 2% V, balance Fe and incidental impurities.

11. The method of making a compound body wherein a first component of 25 to 75% by volume of a hard material powder and 75 to 25% by volume of a high speed steel, said hard material powder comprising 30 to 70% by volume of a compound selected from the group consisting of carbides, nitrides, oxides, borides and mixtures thereof, of a metal selected from the group consisting of Ti, Zr, Hf, V, Nb, Ta, Mo, Cr, W and mixtures thereof, and a second component selected from the group consisting of (a) hard materials comprising from 30 to 70% by volume of hard constituents of particles selected from the group consisting of Ti, Zr, Hf, V, Nb, Ta, Mo, Cr, W and mixtures thereof; and (b) high speed steel or tool steel in a matrix based on a metal selected from the group consisting of Fe, Ni, Co and mixtures thereof are compacted by cold isostatic pressing to form an extrusion billet which is thereafter hot extruded to form a compound body blank.

12. The method of claim 11 wherein one of said components is pre-compacted prior to forming the extrusion billet.

13. The method of claim 11 wherein one of said components is pre-compacted to form a hollow body.

14. The method of claim 13 wherein the other said components is a powder disposed in the hollow area of said precompacted component to form the extrusion billet.

15. The method of claim 12 wherein the other of said components is a powder disposed around the pre-compacted component to form the extrusion billet.

16. The method of claim 11 wherein both said first and second components are in particulate form prior to said compaction.

17. The method of claim 11 wherein at least part of the exterior surface of the compound body blank is formed of hard materials.

* * * * *